United States Patent [19]

Toledo

[11] 4,082,655

[45] Apr. 4, 1978

[54] PECAN-WORM SEPARATOR PROCESS AND APPARATUS

[75] Inventor: Romeo T. Toledo, Athens, Ga.

[73] Assignee: Tracy-Luckey Co., Inc., Harlem, Ga.

[21] Appl. No.: 716,634

[22] Filed: Aug. 23, 1976

[51] Int. Cl.[2] ..... B03D 1/14

[52] U.S. Cl. ..... 209/173; 209/2

[58] Field of Search ..... 209/172, 173, 2, 464, 209/208, 210, 155, 156, 157, 458, 490, 492, 494, 493, 172.5

[56] References Cited

U.S. PATENT DOCUMENTS

| | | | |
|---|---|---|---|
| 994,654 | 6/1911 | Parker | 209/173 |
| 3,086,718 | 4/1963 | Lukas | 209/172.5 |
| 3,364,035 | 1/1968 | Belk | 209/173 |
| 3,430,764 | 3/1969 | Hensley | 209/173 |
| 3,765,532 | 10/1973 | Morris et al. | 209/173 |

*Primary Examiner*—Frank W. Lutter
*Assistant Examiner*—Jon Hokanson
*Attorney, Agent, or Firm*—Newton, Hopkins & Ormsby

[57] ABSTRACT

Method and apparatus for separating pecan nut meat from pecan weevil larvae which involves utilizing a liquid having a specific gravity less than 1.0, allowing the pecan nut meat to sink and the pecan weevil larvae to float, and the separation and recovery of the pecan meat in the substantial absence of the larvae.

13 Claims, 6 Drawing Figures

PECAN-WORM SEPARATOR PROCESS AND APPARATUS

BACKGROUND OF THE INVENTION

Pecan nut meat often contains the larvae of the pecan weevil, curculio caryae (Horn). This larvae has very similar color characteristics as the small pecan nut meat fragments and optical techniques for automatic separation are not sufficient. Present procedures for separating this larvae involve visual inspection of the nut meat in a dark room under ultraviolet light and in a lighted room under flourescent light, and picking out the larvae by hand. This is a very tedious and boring task. The labor cost is not only excessive, but efficiency is also poor because only a slight distraction of the inspector allows enough larvae to be missed as requires passing the pecan meat through inspection for the second time.

Although floatation techniques are widely practised in the pecan industry for the separation of fragments of the hulls, stones and other debris from the pecan meat, it is not heretofore been considered possible to effect the floatation separation of pecan nut meat from the larvae.

BRIEF SUMMARY OF THE INVENTION

It is therefore an object of this invention to provide an improved separation process and apparatus for its practise in which a mechanical separation is effected between the pecan nut meat and the larvae. Basically, the invention involves the discovery that it is possible by utilizing a liquid having a specific gravity less than 1.0 to effect floatation separation between the pecan nut meat and larvae with a high degree of efficiency both as regards the percentage of larvae removed and the percentage of pecan nut meat recovered.

Preferably, the liquid employed is an aqueous solution of ethyl alcohol or of isopropyl alcohol.

The invention is based upon the discovery that by adjusting the specific gravity of the separating liquid to a value which is close to the transition between a condition in which none of the pecan meat floats therein and a condition in which a well-defined layer of pecan meat floats therein, a very high efficiency both as to the percentage of larvae removed and the percentage of pecan meat recovered can be achieved.

The separating effect is achieved by skimming off the top surface layer of the liquid and thus removing the larvae and by discharging an underflow of the liquid together with the pecan meat carried along thereby.

The process preferably is a continuous one in which a flowing channel of the liquid is maintained, properly adjusted as to specific gravity value, and with there being a screen means disposed across the flow channel. The screen means is inclined in its direction across the flow channel, for example it may be V-shaped, to divert the larvae to a skimming off region. Preferably, also, the screen means inclines downwardly in the direction of liquid flow from the surface of the liquid to direct the sinking pecan meat toward the underflow discharge opening.

Preferably, the apparatus includes a drainage means receiving the liquid and pecan meat from the underflow discharge and this means preferably is in the form of a vibrating trough which simultaneously drains off the liquid and returns it to the circulating means while effecting a vibrating conveyor action on the pecan meats for ultimate discharge and recovery.

BRIEF DESCRIPTION OF THE DRAWING FIGURES

Figure 1:
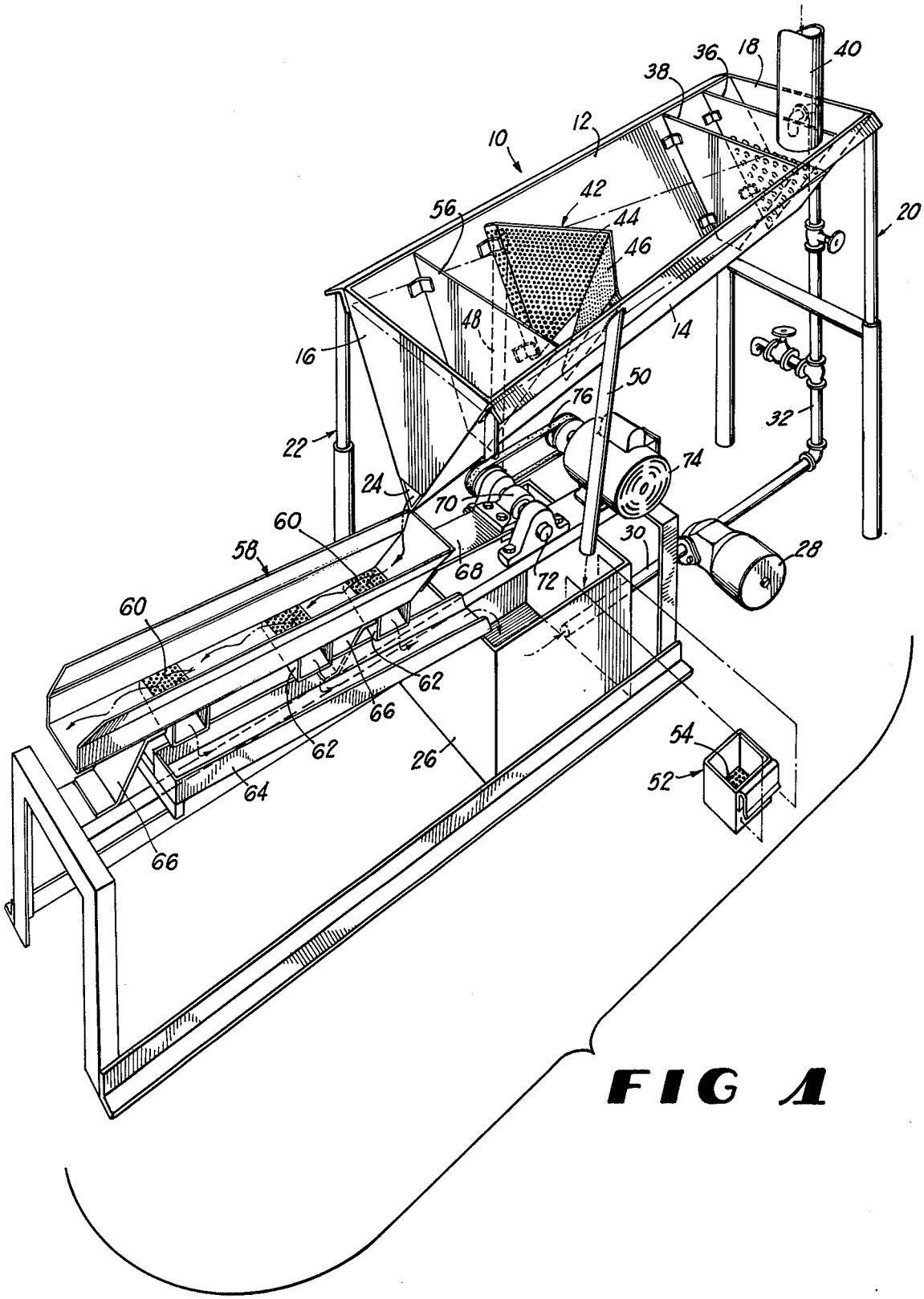
FIG. 1 is a perspective view illustrating apparatus constructed in accord with the present invention.

As noted above, the invention relates to the discovery that the utilization of a floatation liquid having a specific gravity less than 1.0 makes it possible successfully to separate pecan nut meat from the pecan weevil larvae. It is therefore of concern to choose a floatation medium which does not contaminate the pecan nut meat. Two materials which meet this test are ethyl alcohol and also isopropyl alcohol and both are usable in accord with the present invention since both are allowed as food additives. After recovery of the pecan nut meat, residual liquid is removed first by draining, and the alcohol is removed by washing the pecan meat with water and drying to a moisture content of approximately 4%.

The following table illustrates certain principles of the present invention tabulated with respect to ethyl alcohol.

| Floatation medium aqueous ethyl alcohol ethyl alcohol in per cent | Specific gravity | percent of total number of larvae floating | extent of pecan floaters |
|---|---|---|---|
| 100 | 0.789 | 70.4 | none |
| 60 | 0.899 | 88.5 | none |
| 50 | 0.914 | 91.6 | negligible |
| 45 | 0.925 | 98.2 | negligible |
| 40 | 0.935 | 98.7 | ⅛ inch layer of floaters |
| 30 | 0.951 | 99.2 | ½ inch layer of floaters |
| 0 | 1.00 | 100 | all pecans floated |

From the above, it will be apparent that in order successfully to separate the pecan nut meat from the larvae while at the same time obtaining sufficient efficiency in the percentage of larvae removed and sufficient percentage of pecan nut meat recovered, there is a narrow range of specific gravity in which the transition from a negligible amount of pecan floaters to a well-defined layer of pecan floaters obtains. In accord with the above table, it will be seen that for the specific example tabulated, the proper specific gravity of the floatation medium is about 0.925. It will be noted that at this specific gravity, the percentage of larvae which floats is 98.2% while still attaining a negligible extent of pecan floaters whereas at a specific gravity of 0.935, the percentage of larvae floating has increased only by 0.5% while a well-defined layer of pecan floaters prevails at this latter specific gravity. On the other hand, at a specific gravity of 0.914, there is only 91.6% of larvae floating with a still negligible extend of pecan floaters but, obviously, this latter value of specific gravity should not be used because it is not sufficiently close to the aforesaid transition region. Accordingly, in order to achieve an efficiently high percent of larvae floating and thereby removed from the system while still obtaining a high yield of recovered pecan nut meats, the specific gravity should be directed to a value which is just above that value at which the transition between negligible extent of pecan floaters and a well-defined layer of pecan floaters is observed.

It will be appreciated that the density of pecan meat will vary as between different batches depending upon moisture content and varying oil contents, the specific gravities tabulated hereinabove are not exact for all conditions. However, the range of specific gravities which are useful in connection with this invention have been found to vary between about 0.91 to about 0.95.

A good value from which to start is a specific gravity of approximately 0.92 at 20° C, corresponding to an isopropyl alcohol content of approximately 41% by weight or an ethyl alcohol content of about 45% by weight, both as aqueous solutions. The solution may then be tested by introducing a quantity of pecan nut meat to determine the extent of floatation thereof and the specific gravity can then by adjusted either by adding more water or by adding more alcohol until the desired degree of sinking of pecans and floatation of the larvae is obtained.

Preferably, the process is carried out on a continuous basis and, for this purpose, apparatus in accord with the drawings can be utilized.

Figure 2:
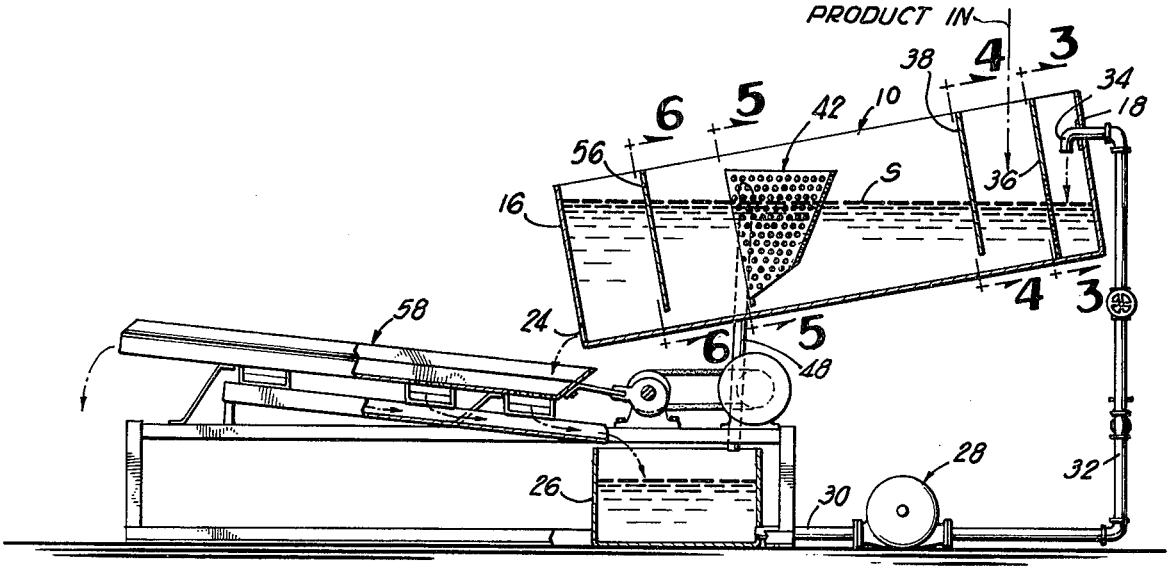
FIG. 2 is a vertical section, partly in elevation, of the assembly shown in FIG. 1.
Figure 3:
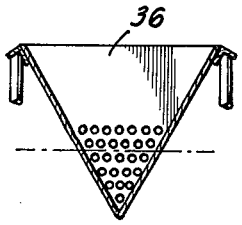
FIG. 3 is a transverse sectional view taken along the plane of Section line 3—3 in FIG. 2.
Figure 4:
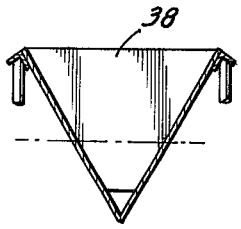
FIG. 4 is a transverse sectional view taken along the plane of Section line 4—4 in FIG. 2.
Figure 5:
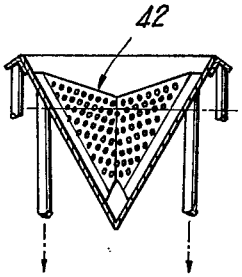
FIG. 5 is a transverse sectional view taken along the plane of Section line 5—5 in FIG. 2.
Figure 6:
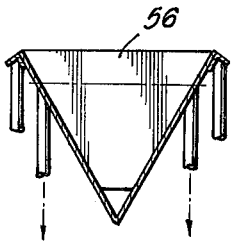
FIG. 6 is a transverse sectional view taken along the plane of Section line 6—6 in FIG. 2.

In the embodiment shown in FIG. 1, the apparatus includes a container section indicated generally by the reference character 10 which as illustrated may be in the form of an elongate trough-like body having sloping side walls 12 and 14 and provided with the opposite end walls 16 and 18 as illustrated. The flow channel or container section 10 is supported by suitable framework such as the leg assemblies 20 and 22 with this section being in inclined disposition as will be seen more clearly in FIG. 2 with the bottom portion of the end wall 16 being provided with an underflow discharge opening 24.

A supply tank 26 for the separating medium is provided beneath the section 10 as is illustrated and a circulating means in the form of a pump and motor assembly 28 withdraws the liquid from the reservoir 26 through the pipe 30 and discharges it through the pipe 32 directly into the elevated end of the section 10 at 34 as indicated. A triangular, perforated baffle 36 is located closely adjacent the end wall 18 and further downstream there is provided a trapezoidal baffle 38, these two baffles operating to minimize any turbulence particularly at the surface of the liquid downstream of the baffle 38 which might otherwise interfere with the proper separating action. The pecan nut meat which may be contaminated with the larvae as described above is introduced through a supply chute 40 for introduction just downstream of the baffle 38, it being appreciated that the circulating pump and motor assembly 28 circulates liquid into the section 10 at a rate sufficient to balance the underflow discharge through the opening 24 and maintain a selected level or height of the liquid surface S thereby creating a continuous flow channel through the section 10 which tends to carry along the larvae and the pecan nut meat toward the lower end of the section 10.

Downstream from the point of pecan nut meat introduction there is provided a screen means indicated generally by the reference character 42 which extends across the flow channel. This screen assembly performs several functions. First of all, it holds back the floating material which is principally the larvae and it furthermore directs the larvae to skimming off regions by virtue of the V-shape of the assembly 42. Further, it inclines downwardly in the direction of liquid flow and thus directs the pecan nut meat toward the underflow discharge opening 24. The skimming off regions are defined at the surface S by the convergence of the screen sections 44 and 46 with their respective side walls 12 and 14 and the discharge pipes 48 and 50 present openings through the side walls 12 and 14 at these regions at the level of the surface S. These pipes 48 and 50 discharge into the removable drainage buckets such as that illustrated in FIG. 1 by reference character 52 which is removably supported on the side of the reservoir 26 and which has a perforate bottom wall 54 which retains the discharged larvae but allows the liquid to drain back into the supply tank 26.

Downstream of the screen means 42 is a further trapezoidal baffle 56 which further controls the underflow to the discharge opening 24. Thus, the liquid together with the pecan nut meat is efficiently discharged through the opening 24 into the vibrating conveyor trough indicated generally by the reference character 58 having one end thereof disposed below the underflow opening 24.

The bottom of the conveyor section 58 is provided with one or more perforate sections such as those indicated by reference character 60 which discharge into laterally directed drain channels 62 in turn discharging into the chute 64 leading back to the reservoir 26. The conveyor section 58 is supported by suitable resilient or spring elements 66 and is rapidly vibrated by means of a plate 68 attached at one end thereof which carries a bearing 70 journalling therein an eccentric portion of the shaft 72 rotatably driven by means of the motor 74 and the belt drive 76 so that the conveyor section 58 operates in the well-known vibrating conveyor principle fashion to convey the collected pecan nut meat toward the discharge end of such conveyor section.

I claim:

1. The method of separating pecan nut meats from pecan weevil larvae therewith, which comprises the steps of:

(a) providing a trough having a bottom opening at one end;

(b) effecting a continuous flow through said trough of a liquid medium which is a mixture of water and alcohol acceptable as a food additive by continuously discharging the liquid medium through said bottom opening at said one end of the trough while continuously introducing the liquid medium into the other end of said trough at a rate sufficient to entrain and carry along said pecan meats while maintaining a selected level of the liquid medium within said trough;

(c) introducing pecan nut meats containing said larvae into said liquid medium adjacent said other end of the trough;

(d) adjusting the ratio of alcohol and water in said medium to obtain a specific gravity of the liquid medium which is within the range 0.91 to 0.95 and which specific gravity is effective to float substantially all of said larvae and only a negligible amount of said pecan nut meats on the surface of said liquid medium while allowing substantially all of the pecan meats to sink;

(e) intercepting and removing the entrained floating material at a region between the region of introduction of step (c) and said one end of the trough while simultaneously directing the entrained sunken material toward said bottom opening;

(f) continuously discharging the liquid material with entrained sunken material from said bottom opening onto a porous conveyor and recirculating the liquid medium passing through the conveyor back for introduction into the trough in step (b); and (g) continuously recovering the pecan meats from the conveyor and drying them to obtain an edible product.

2. The method according to claim 1 wherein said liquid medium is an aqueous solution of ethyl alcohol.

3. The method according to claim 1 wherein said liquid medium is an aqueous solution of isopropyl alcohol.

4. The method according to claim 1 wherein step (e) is effected by a screen extending above and below said surface of the liquid medium, said screen extending transversely of said trough at an oblique angle to the direction of the liquid flow whereby to cause the floating material to flow to the region of its removal, and being inclined with respect to said surface toward said bottom opening to direct the sunken material toward such bottom opening.

5. The method according to claim 4 wherein said liquid medium in each instance is an aqueous solution of ethyl alcohol.

6. The method according to claim 4 wherein said liquid medium in each instance is an aqueous solution of isopropyl alcohol.

7. Apparatus for separating pecan nut meat from pecan weevil larvae admixed therewith, comprising in combination:

container means for defining a flow channel for a body of liquid having a specific gravity less than 1.0;

circulating means for continuously supplying said liquid to one end of the flow channel, said container means having an underflow discharge opening at the other end of the flow channel whereby the circulating means maintains a selected level of the liquid within the flow channel;

screen means disposed downstream from said one end of the flow channel for directing pecan nut meat carried along by said liquid below the surface thereof toward said underflow discharge opening, said screen means also diverting pecan weevil larvae floating on the surface of said liquid toward a skimming off region;

drainage means receiving liquid and pecan nut meat discharged through said underflow discharge opening for recovering the pecan nut meat while returning the liquid to said circulating means; and discharge means located at said selected level of the liquid in said skimming off region for removing the pecan weevil larvae floating on the liquid from the flow channel.

8. Apparatus as defined in claim 7 wherein said container means is elongate and said screen means is V-shaped and extends across said container means.

9. Apparatus as defined in claim 8 wherein said screen means is also inclined downwardly from said level of the liquid in the direction of liquid flow.

10. Apparatus as defined in claim 9 wherein said drainage means is in the form of a trough having a perforate bottom portion for draining off the liquid.

11. Apparatus as defined in claim 10 including means for resiliently mounting said trough, and means for vibrating said trough to move pecan nut meats toward one end thereof as the liquid is draining off.

12. Apparatus as defined in claim 7 wherein said drainage means is in the form of a trough having a perforate bottom portion for draining off the liquid.

13. Apparatus as defined in claim 12 including means for resiliently mounting said trough, and means for vibrating said trough to move pecan nut meat toward one end thereof as the liquid is draining off.

* * * * *